US005454608A

United States Patent [19]

Dzurko et al.

[11] Patent Number: 5,454,608

[45] Date of Patent: Oct. 3, 1995

[54] VEHICLE DOOR LATCH

[75] Inventors: Thomas A. Dzurko, Mt. Clemens; Frank J. Arabia, Jr., Shelby Township; Ian Martin, Pontiac, all of Mich.

[73] Assignee: General Motors Corporation, Detroit, Mich.

[21] Appl. No.: 134,820

[22] Filed: Oct. 12, 1993

[51] Int. Cl.[6] ..... E05C 3/16

[52] U.S. Cl. ..... 292/216; 292/DIG. 23; 292/DIG. 27

[58] Field of Search ..... 292/216, 336.3, 292/DIG. 3, DIG. 23, DIG. 27

[56] References Cited

U.S. PATENT DOCUMENTS

| | | | |
|---|---|---|---|
| 3,602,019 | 8/1971 | Kazaoka | 292/216 X |
| 4,342,209 | 8/1982 | Kleefeldt | 70/264 |
| 4,364,249 | 12/1982 | Kleefeldt | 70/264 |
| 4,440,006 | 4/1984 | Kleefeldt | 70/264 |
| 4,727,301 | 2/1988 | Fulks et al. | 318/468 |
| 4,756,563 | 7/1988 | Garwood et al. | 292/216 |
| 4,929,007 | 5/1990 | Bartczak et al. | 292/216 X |
| 4,969,673 | 11/1990 | Portelli et al. | 292/DIG. 27 X |
| 4,974,886 | 12/1990 | Kleefeldt et al. | 292/201 |
| 5,046,341 | 9/1991 | Ogino et al. | 292/216 X |
| 5,054,827 | 10/1991 | Konchan et al. | 292/216 |
| 5,253,906 | 10/1993 | Rogers, Jr. et al. | 292/216 |
| 5,277,461 | 1/1994 | Dzurk et al. | 292/DIG. 27 X |

*Primary Examiner*—Rodney M. Lindsey
*Attorney, Agent, or Firm*—Charles E. Leahy

[57] ABSTRACT

A vehicle door latch has a fork bolt lever that is latched by a detent lever. The detent lever is operated by an intermittent lever that is operated by a transfer lever that is actuated by inside and outside door handles via operating levers. The door latch includes a locking lever that disconnects the door handle from the intermittent lever when it is in the locked position. The door latch also includes an anti-theft feature in the form of an electrically actuated "dead bolt" lock that is engaged and disengaged solely by a key lock cylinder. The door latch further includes an override feature that unlocks the door latch mechanically in the event of electrical power failure.

19 Claims, 4 Drawing Sheets

VEHICLE DOOR LATCH

BACKGROUND OF THE INVENTION

This invention relates to vehicle door latches, and more particularly, to a vehicle door latch that has an anti-theft feature.

Automotive vehicles have a door latch on each vehicle door to latch the door in the closed position. Each vehicle door latch includes a lock that is commonly actuated from inside the vehicle by a readily accessible sill button or other manually operable device on the door. The vehicle door lock for the front doors is conventionally operated from outside the vehicle as well, usually by a key lock cylinder that has a removable key to deter theft.

Upscale automotive vehicles commonly employ a power lock system as a convenience feature. The power lock system commonly employs an electrically powered actuator associated with each door latch (and sometimes also with the trunk latch and fuel filler door latch) to move the door lock between its locked and unlocked positions. The actuators are controlled in a variety of ways. In a central vehicle door lock system, or at least in the American version of such a system, all the actuators are controlled by any one of three switches. These three switches are located in the key lock cylinder for the driver's door and on the interior trim panel for each front door. Thus, all doors can be locked or unlocked from outside the vehicle by means of the key lock cylinder switch in the driver's door, or from inside the vehicle by means of the switches next to the driver or the front seat passenger.

Manual and power door lock systems have a common problem. As indicated above, the front door locks are commonly actuated from outside the vehicle by a key lock cylinder that has a removable key to deter theft. In four door vehicles, the rear door locks cannot be unlocked from outside the vehicle. However, the door lock for any door is commonly actuated from inside the vehicle by a readily accessible sill button or other manually operable device that does not have any theft deterrent feature. Consequently, the theft deterrent aspect of the key operated door lock can be circumvented by breaking a vehicle window, reaching inside the vehicle and unlocking the vehicle door by means of one of the inside sill buttons or its equivalent.

To overcome this circumvention technique, an anti-theft feature has been developed for vehicle door latches as a counter measure in the case of electrically operated door latches used in central locking or power door lock systems. See, for instance, U.S. Pat. No. 4,342,209 granted to Frank Kleefeldt Aug. 3, 1982; U.S. Pat. No. 4,364,249 granted to Frank Kleefeldt Dec. 21, 1992; U.S. Pat. No. 4,440,006 granted to Frank Kleefeldt Aug. 3, 1984; and U.S. Pat. No. 4,727,301 granted to Fulks et al. Feb. 23, 1988.

By way of example, U.S. Pat. No. 4,342,209 granted to Frank Kessfeldt Aug. 3, 1982, discloses a central vehicle door lock system that has several door latches each of which includes a detent and a mechanism inside the door latch that moves the detent between a lock position securing the door closed and an unlock position that allows the door to be unlatched and opened. Each door latch is associated with a servoactuator that has an actuator that moves the detent via this internal mechanism; the actuator, in turn, being moved by an operator. The operator itself can be moved into an anti-theft position by a servomotor to engage a lock pawl so that the actuator is locked in a locked position. The servomotors are all controlled by a central key switch which can operate all the door latches between the lock, unlock and anti-theft position. None of the door latches can be unlocked when the anti-theft feature is engaged.

One disadvantage of prior art systems is that there is no practical way for an authorized person to enter the automobile if the anti-theft feature cannot be disengaged for one reason or another. This possibility can occur, for instance, in the case of an electrical power failure in a central locking system.

SUMMARY OF THE INVENTION

The object of this invention is to provide a vehicle door latch that has an anti-theft feature and an override which enables an authorized person to unlock the door latch in the event that the anti-theft feature cannot be disengaged.

A feature of the invention is that the vehicle door latch has a mechanical override that can be operated even in the event of a power failure.

Another feature of the invention is that the vehicle door latch has an override that is simple and economical to manufacture.

Another feature of the invention is that the vehicle door latch has an override that is compact so that it can fit into existing space in the door latch.

Another feature of the invention is that the vehicle door latch has an override that makes maximum use of existing parts of the door latch.

Still yet another feature of the invention is that the vehicle door latch has an override that can be provided by a single additional molded plastic part so that the override can be provided for practically nothing.

BRIEF DESCRIPTION OF THE DRAWINGS

The above and other objects, features and advantages of the invention will become more apparent from the following description taken in conjunction with the accompanying drawings, wherein like references refer to like parts and wherein.

DESCRIPTION OF THE INVENTION

Figure 5:
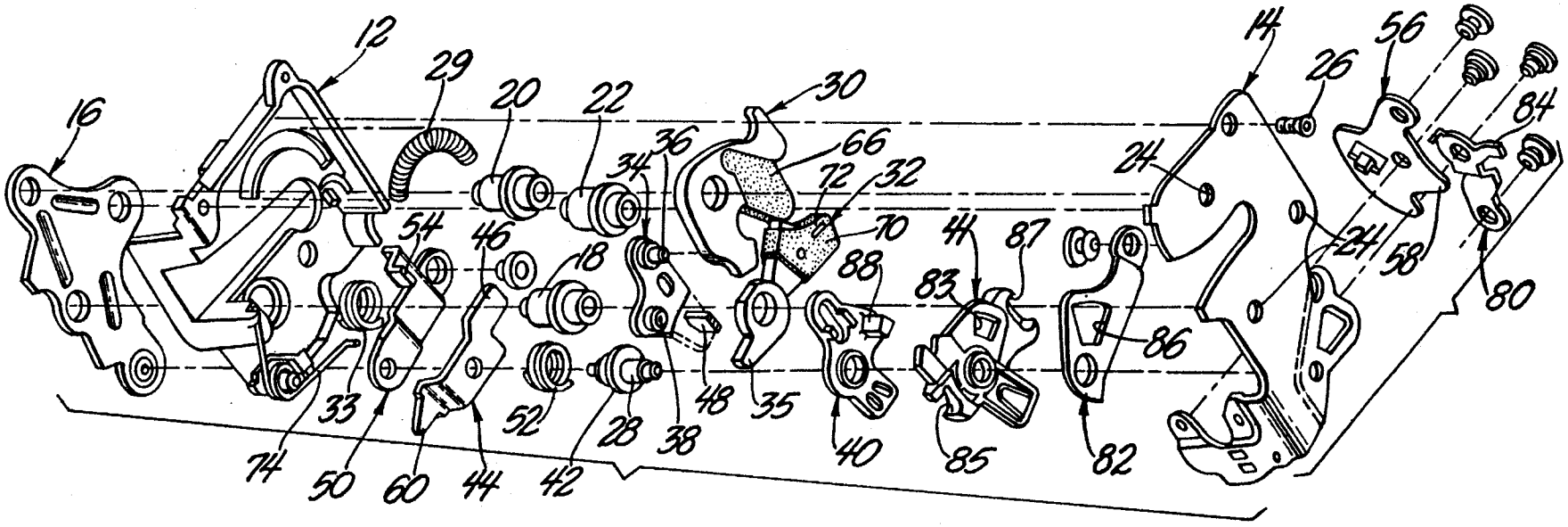
FIG. 5 is an exploded perspective view of the vehicle door latch that is shown in FIGS. 1–4.

Referring now to the drawings, and more particularly to the exploded perspective view of FIG. 5, the vehicle door latch 10 is the same basic arrangement as the vehicle door latches that are disclosed in U.S. Pat. No. 4,756,563 granted to Stephen L. Garwood and Jeffrey Konchan Jul. 12, 1988, for a vehicle door latch and U.S. Pat. No. 5,054,827 granted to Jeffrey L. Konchan and Jiri Paulik Oct. 8, 1991, for a vehicle door latch.

The vehicle door latch 10 has a three piece enclosure that comprises a plastic housing 12, a metal face plate 14 and a metal back plate 16. The plastic housing 12 and the metal back plate 16 are held together by three flanged, internally threaded bushings 18, 20 and 22, that are inserted into three holes in the plastic housing 12, then through three aligned holes in the back plate 16 and then flanged over the back plate. The metal face plate 14 has three bolt holes 24 that are aligned with the bushings 18, 20 and 24 when the metal face plate is attached to the plastic housing 12 by a screw 26. The metal face plate 14 and the metal back plate 16 have lower portions below the plastic housing 12 that are held together by a flanged stud 28 that has projecting pins at each end that are inserted in holes in the plates and peened or headed over.

LATCHING MECHANISM

Figure 1:
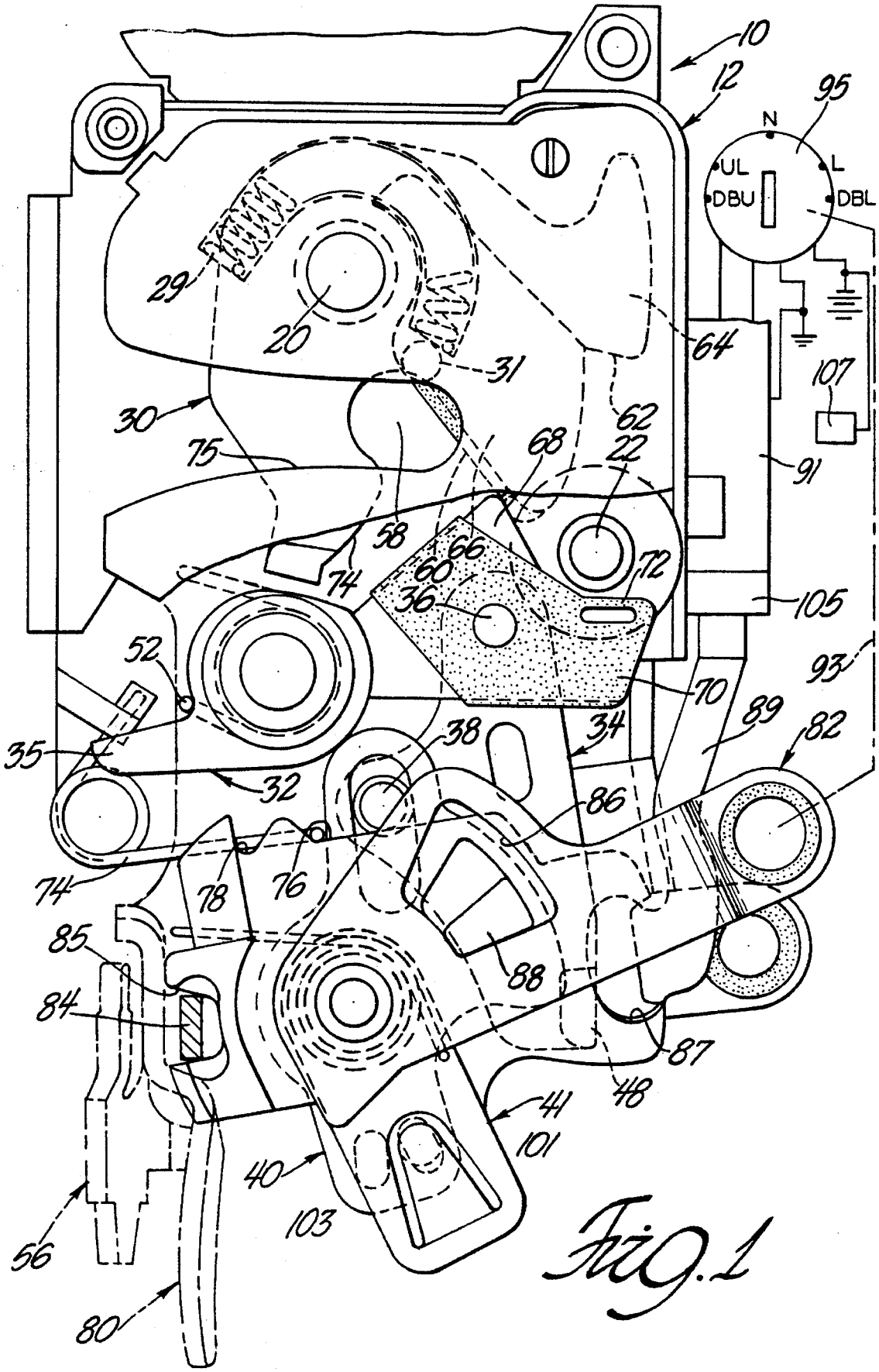
FIG. 1 is a front view of a vehicle door latch in accordance with the invention, the vehicle door latch being shown in a latched but unlocked condition.
Figure 2:
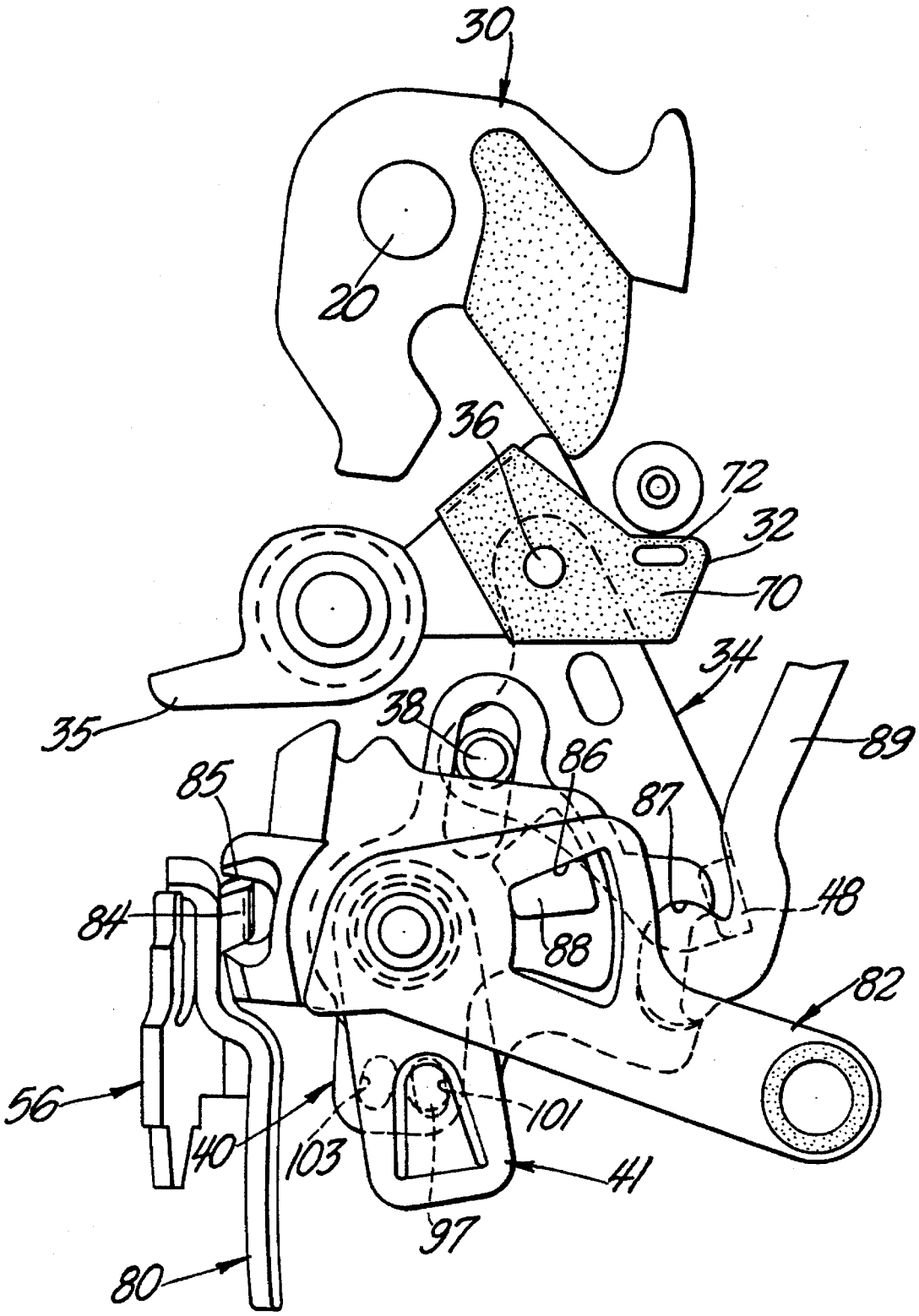
FIG. 2 is a fragmentary front view of the vehicle door latch of FIG. 1 showing parts of the vehicle door latch in a latched and locked condition and with an anti-theft feature engaged.
Figure 3:
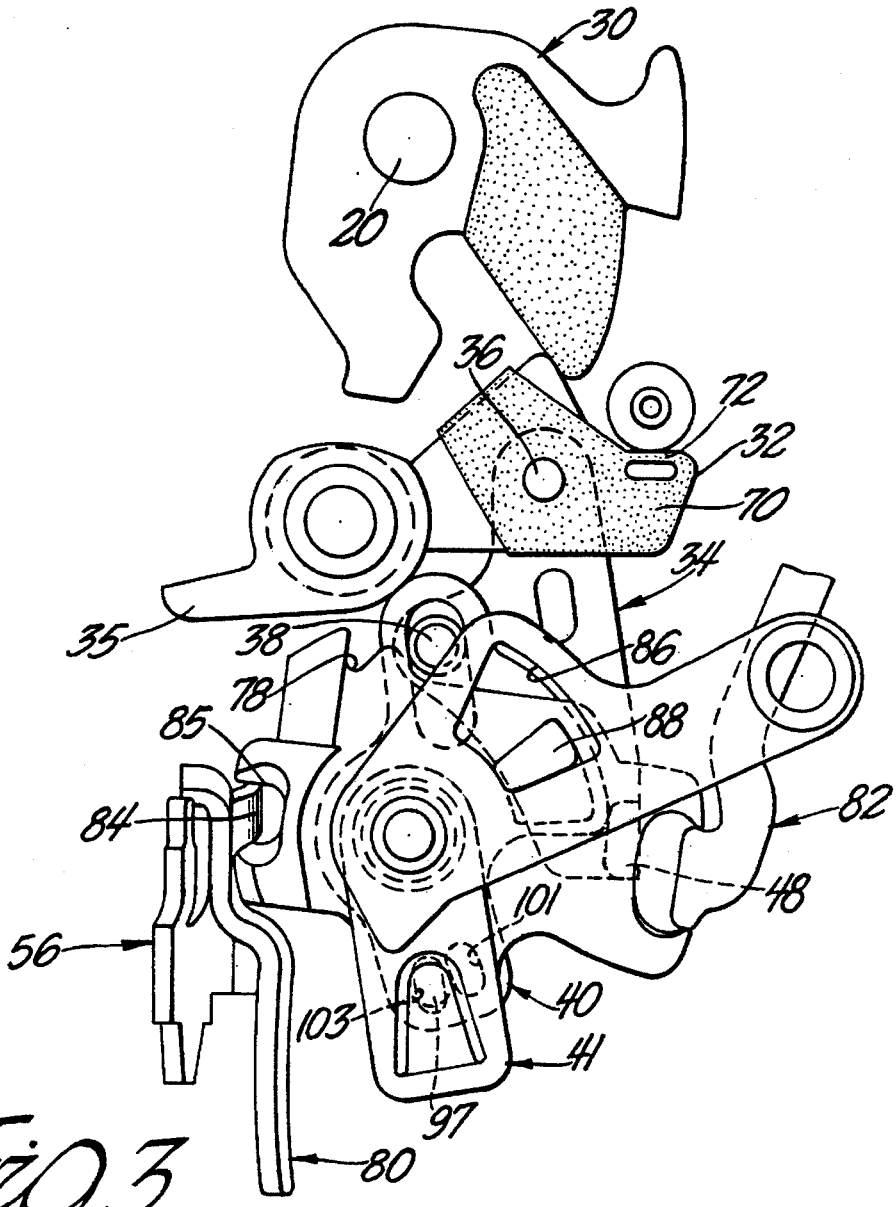
FIG. 3 is a fragmentary front view of the vehicle door latch of FIG. 1 showing parts of the vehicle door latch in an unlock override condition where the vehicle door latch is unlocked with the anti-theft feature engaged.

The latching mechanism of the vehicle door latch 10 comprises a fork bolt lever 30 and a cooperating detent lever 32 that are pivotally mounted on bushings 20 and 18, respectively, and located in a chamber of the plastic housing 12 behind the metal face plate 14. The fork bolt lever 30 is biased clockwise by a coil spring 29. The coil spring 29 is disposed in a curved slot in the plastic housing 12 behind the fork bolt lever 30 and engages a depending pin 31 of the fork bolt lever 30 at one end. The detent lever 32 is biased counterclockwise into engagement with the fork bolt lever 30 by a coil spring 33 that surrounds the bushing 18 and that has one end engaging the plastic housing 12 and the other end engaging an ear 35 of the detent lever 32. The detent lever 32 engages the fork bolt lever 30 in its latched position as shown in FIG. 1 and engages and holds the fork bolt lever 30 in full latched position against the bias of spring 29 as shown in FIGS. 1, 2 and 3. The operation is explained more fully below.

The latching mechanism further comprises an intermittent lever 34 for operating the detent lever 32. The intermittent lever 34 is located in the chamber of the plastic housing 12 behind the detent lever 32. It has two integral pivot pins 36 and 38. Pivot pin 36 is journalled in a hole in the detent lever 32 so that the detent lever 32 rotates clockwise from the position shown in FIGS. 1, 2 or 3 and out of latched engagement with the fork bolt lever 30 when the intermittent lever 34 is pulled down. This allows the fork bolt lever 30 to rotate counterclockwise to an unlatched position when the vehicle door is opened.

The second pivot pin 38 is disposed in a slot of a first locking lever part 40 so that the locking lever part 40 pivots the intermittent lever 34 counterclockwise about pivot pin 36 when the locking lever part 40 is rotated clockwise from the unlocked position shown in FIGS. 1 and 3 to the locked position shown in FIG. 2. The first locking lever part 40 is journalled on the stud 28 between the flange 42 and the face plate 14.

The first locking lever part 40 cooperates with a second locking lever part 41 that is journalled on the stud 28 between the first locking lever part 40 and the face plate 14. The second locking lever part 41 normally drives the first locking lever part 40. However, the locking lever parts 40 and 41 are coupled by a releasable spring biased detent that permits relative angular displacement so that the locking lever parts 40 and 41 can be rotated independently of each other.

The locking lever parts 40 and 41 are shown in detail in FIG. 4, and the operation of the locking lever parts 40 and 41 is explained in greater detail below in connection with the description of the locking mechanism, the anti-theft feature, and the mechanical override feature. These two locking lever parts 40 and 41 fit in essentially the same space as the single locking lever of U.S. Pat. Nos. 4,756,563 and 5,054,827. Yet, these two locking lever parts 40 and 41 cooperate to provide features not possible with the single locking lever of the prior art as indicated above.

The latching mechanism further comprises a transfer lever 44 that is journalled on a reduced diameter portion of the stud 28 spaced rearwardly of the flange 42. The transfer lever 44 has an ear 46 at one end that is engageable with an integral, rearwardly projecting tab 48 of the intermittent lever 34, so that the intermittent lever 34 is pulled down when the transfer lever 44 is rotated clockwise as viewed in FIG. 5.

The latching mechanism further comprises an outside operating lever 50 and a coil return spring 52. The outside operating lever 50 is also journalled on the reduced diameter portion of the stud 28 behind the transfer lever 44. It has a bent tab 54 that engages the ear 46 of the transfer lever 44 so that the outside operating lever 50 rotates the transfer lever 44 clockwise when it is rotated clockwise on stud 28. The outside operating lever 50 is connected by suitable linkage for rotation by an outside door handle (not shown).

The coil return spring 52 is disposed around the stud 28 and located between the flange 42 and the transfer lever 44. One end of the coil spring 52 engages the bottom of transfer lever 44, and the other end engages the bottom of the plastic housing 12 above the transfer lever 44, so that the transfer lever 44 and outside operating lever 50 are biased counterclockwise to a rest position where tab 54 engages the bottom of the plastic housing 12.

The latching mechanism further comprises an inside operating lever 56 that is pivotally mounted on a flange of the metal face plate 14. The inside operating lever 56 has a tab 58 that engages a second ear 60 of the transfer lever 44 so that the inside operating lever also rotates the transfer lever 44 clockwise when it is rotated counterclockwise. The inside operating lever 56 is connected by suitable linkage for rotation by an inside door handle (not shown).

Referring now to FIG. 1, the fork bolt lever 30 has a conventional slot or throat 58 for receiving and retaining a striker member, such as that shown in the U.S. Patents discussed above, that is attached to the door pillar to latch the door in the closed position (not shown). The fork bolt lever 30 also includes a primary latch shoulder 60, an intermediate latch shoulder 62 and a radially projecting foot 64. The fork bolt lever 30 also has a plastic coating 66 that covers a surface of the slot 58 that is engaged by the striker for energy absorption and quiet operation when the vehicle door is slammed shut.

The detent lever 32 has a sector shaped catch 68 that positively engages the primary latch shoulder 60 to hold the fork bolt lever 30 in the full latched position, as shown in FIGS. 1, 2 and 3. The sector shaped catch 68 also positively engages an intermediate latch shoulder 62 to hold the fork bolt lever 30 in an intermediate latched position rotated counterclockwise from the full latched position shown in FIGS. 1, 2 and 3. On the other hand the sector shaped catch 68 rests on the radially projecting foot 64 when the fork bolt lever 30 is released and rotated to an unlatched position still further counterclockwise from the full latched position shown in FIGS. 1, 2 and 3.

The detent lever 32 also includes a plastic coating 70 which has a slotted portion that provides an integral bumper 72. The bumper 72 engages the bushing 22 to stop counterclockwise pivoting of the detent lever 32 under the bias of spring 52. This bumper 72 also absorbs energy and quiets operation when the door is slammed shut.

The latching mechanism operates as follows. When the door latch 10 is in an unlatched and unlocked condition (not shown), the fork bolt lever 30 is poised to receive a conventional striker (not shown) that projects into aligned fishmouth slots 74 and 75 of the plastic housing 12 and the metal face plate 14 when the door is shut. The entering striker engages the plastic coating 66 at the back of the throat 58 and rotates the fork bolt lever 30 counterclockwise against the bias of spring 29 until the fork bolt lever 30 is rotated to the full latch position shown in FIGS. 1, 2 and 3, where the fork bolt lever 30 captures the striker in the throat 58. The fork bolt lever 30 is held in the full latch position by the catch 68 of the detent lever 32 engaging the primary latch shoulder 60 of the fork bolt lever 30.

The catch 68 rides along the periphery of the fork bolt lever 30 under the bias of spring 52 as the fork bolt lever 30 rotates counterclockwise from the unlatched position to the full latch position. During this travel, the catch 68 rides under the foot 64 into engagement with the intermediate latching shoulder 62 and then under the coated portion into engagement with the primary latching shoulder 60. It is to be noted that the engagement of the catch 68 with the intermediate latching shoulder 62 is sufficient to hold the vehicle door closed in the event that the vehicle door is not shut completely so that the catch 68 engages the primary latch shoulder 60.

The vehicle door latch 10 is unlatched so that the vehicle door can be opened by operating either the inside or the outside door handle to rotate the transfer lever 44 clockwise and the ear 46 down, as viewed in FIG. 5. The ear 46 engages projection 48 of intermittent lever 34 and pulls the intermittent lever down from the full latch position shown in FIGS. 1, 2 and 3, to an unlatch position (not shown). As the intermittent lever 34 is pulled down, it rotates the detent lever 68 clockwise against the bias of spring 52 from the latch position shown in FIGS. 1, 2 and 3, to an unlatch position (not shown) where the catch 68 clears the latch shoulders 60 and 62. The fork bolt lever 30 is then free to rotate counterclockwise under the bias of spring 29 from the full latch position shown in FIGS. 1, 2 and 3, to an unlatch position as the striker is pulled out of the aligned fishmouth slots 74 and 75 when the vehicle door is opened.

LOCKING MECHANISM

Returning to FIG. 5, the vehicle door latch 10 includes a freewheeling type lock mechanism for disconnecting the latching mechanism so that operation of either the inside door handle or the outside door handle is ineffective in unlatching the, detent lever 32. The lock mechanism comprises the locking lever parts 40 and 41 that are pivotally mounted on the stud 28 between the flange 42 and the metal face plate 14. As indicated above, the locking lever part 40 is also connected to the intermittent lever 34 by a pin and slot arrangement that allows these two parts to translate and pivot with respect to each other.

The locking lever part 40 pivots on the stud 29 between an unlocked position shown in FIGS. 1 and 3, and a locked position shown in FIG. 2. The locking lever part 40 is held in the unlocked position by the locking lever part 41 which, in turn, is held in the unlocked position by a coil spring 74 that has one end mounted on the plastic housing 12 and the other end engaging a first detent notch 76 in the plastic locking lever part 41. The plastic locking lever part 41 pivots clockwise from this unlocked position shown in FIG. 1, to the locked position shown in FIGS. 2 and 3. The end of the coil spring 74 engages a second detent notch 78 in the locking lever part 41 to hold it in the locked position.

The lock mechanism further comprises inside and outside lock operating levers 80 and 82 and a plunger 89 for pivoting the plastic locking lever parts 40 and 41 back and forth between the locked and unlocked positions.

The inside lock operating lever 80 is pivotally mounted on the flange of the metal face plate 14 in front of the inside operating lever 56 for unlatching the door. It includes a tab 84 that engages in a claw slot 85 in one end of the plastic locking lever part 41, so that the plastic locking lever part 41 is pivoted clockwise from the unlocked position shown in FIG. 1, to the locked position shown in FIG. 2 and 3, when the inside locking lever 80 is pivoted counterclockwise by an inside door handle or slide (not shown).

The locking lever part 41 also has a claw slot 87 in the opposite end that is engaged by the plunger 89 of an electrically powered actuator 91 so that the plastic locking lever part 41 is also pivoted clockwise from the unlocked position shown in FIG. 1 to the locked position shown in FIGS. 2 and 3, when the plunger is extended from the position shown in FIG. 1 to the position shown in FIGS. 2 and 3 by the electrically powered actuator 91. The electrically powered actuator 91 is controlled by a key lock cylinder 95 or one or more two way electrical switches 107 inside the vehicle passenger compartment.

The outside lock operating lever 82 is pivotally mounted on the stud 28 between the locking lever part 41 and the face plate 14. The outside lock operating lever 82 has a sector shaped cut-out 86 that receives an integral projection 88 of the locking lever part 40 that projects through a sector shaped cut-out 83 of the locking lever part 41. This forms two lost motion connections. The first lost motion connection is formed between the outside lock operating lever 82 and the locking lever part 41 by the sector shaped cut-out 86 and the projection 88 so that the key and key cylinder can be returned to a neutral position after the locking lever part 41 is rotated one way or the other.

The second lost motion connection is formed between the locking lever part 40 and the locking lever part 41 by the sector shaped cut-out 83 and the projection 88 so that an anti-theft feature can be bypassed by a mechanical override feature as explained below.

In any event, the locking lever part 40 can be rotated clockwise from the unlocked position shown in FIGS. 1 and 3 to the locked position shown in FIG. 2 by rotating the outside lock operating lever 82 clockwise from the unlocked position shown in FIGS. 1 and 3 to the locked position shown in FIG. 2 and back through suitable linkage 95 indicated schematically by a dashed line 93 in FIG. 1 operated by a key lock cylinder 95 illustrated schematically in FIG. 1.

The lock mechanism operates as follows. When the vehicle door latch 10 in a latched condition as shown in FIG. 1, the lock mechanism is actuated by rotating the locking lever parts 40 and 41 clockwise from the unlocked position shown in FIG. 1 to the locked position shown in FIG. 2.

As indicated above this can be accomplished through rotation of the inside lock operating lever 80 by an inside sill button or lock slide which rotates the locking lever part 41 clockwise from the unlocked position shown in FIG. 1 to the locked position shown in FIG. 2. As the locking lever part 41 rotates clockwise it carries the locking lever part 40 with it due to their coupling by a releasable spring biased detent.

Figure 4:
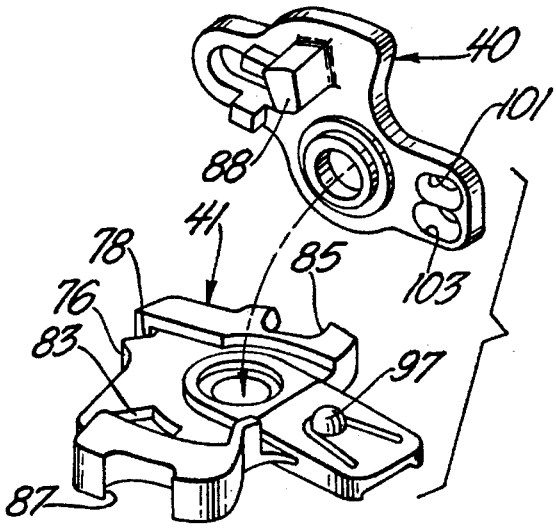
FIG. 4 is an exploded perspective view of the multi-part locking lever of the vehicle door latch that is shown in FIGS. 1–3.

This detent which is best shown in FIG. 4 comprises a knob 97 at the end of an integral leaf spring 99 formed as part of the locking lever part 41. This knob 97 fits into either of two side-by-side pockets 101 and 103 in an arm of the locking lever part 40. The knob 97 is normally disposed in the counterclockwise pocket 101 so that the locking lever part 41 drives the locking lever part 40 to the locking position in the clockwise direction yet allows the locking lever part 40 to back off in a counterclockwise direction to an unlocked position as explained below in connection with the override feature.

The lock mechanism can also be actuated electrically by turning a key in the key lock cylinder 95 clockwise from the neutral position N to the lock position L, or by two way switches in the passenger compartment so as to operate the electrically powered actuator 91 and extend the plunger 89 from the retracted position shown in FIG. 1, to the extended position shown in FIG. 2. This rotates the locking lever part 41 clockwise from the unlocked position shown in FIG. 1, to the locked position shown in FIG. 2. As before, the locking lever part 40 is carried along with the locking lever part 41 due to their coupling by the spring biased detent comprising knob 97 and pocket 101.

In either event, clockwise rotation of the locking lever part 40 by locking lever part 41 also rotates the intermittent lever 34 counterclockwise about the pivot pin 36 due to the engagement of the second pivot pin 38 of the intermittent lever 34 in the slot of the locking lever part 40. The intermittent lever 34 is rotated counterclockwise from the unlocked position shown in FIG. 1, to the locked position shown in FIG. 2, moving the projection 48 out from under the ear 46 of the transfer lever 44. Consequently, when the door handles are operated so as to rotate the transfer lever 44 clockwise to the unlatching position, the ear 46 simply bypasses the projection 48 without transferring any motion to the intermittent lever 34. In other words, the transfer lever 44 simply freewheels so that operation of the door handles is ineffective.

The lock mechanism is unlocked simply by rotating the locking lever part 41 (and the locking lever part 40 along with it) counterclockwise back to the unlocked position shown in FIG. 1, where the projection 48 is beneath the ear 46 of the transfer lever 44 so that clockwise rotation of the transfer lever 44 pulls the intermittent lever 34 and the detent lever 32 down to the disengaged position (not shown). As before, the locking lever part 41 can be rotated through rotation of the inside lock operating lever 80 by an inside sill button or lock slide, or it can be rotated by closing passenger compartment switch 107 or turning a key in the key lock cylinder 95 counterclockwise from the neutral position N to the unlock position UL, so as to operate the electrically powered actuator 91 and retract the plunger 89 from the extended lock position shown in FIG. 2 to the retracted unlock position shown in FIG. 3.

ANTI-THEFT FEATURE

The vehicle door latch 10 also includes an anti-theft feature in the form of a "dead bolt" lock that locks the locking lever part 41 in the lock position so that it cannot be unlocked by either the inside sill button or the passenger compartment switch 107.

This anti-theft feature is actuated by turning a key in the key lock cylinder 95 clockwise past the lock position L to the dead bolt lock position DBL. When this occurs, a positive detent 105 associated with the electrically powered actuator 91 is engaged to lock the plunger 89 in the extended lock position shown in FIGS. 2 and 3. This, in turn, holds the locking lever part 41 in the locked position as shown in FIG. 2 so that it cannot be rotated counterclockwise back to the unlocked position shown in FIG. 1 by the inside locking lever 80 or the passenger compartment switch 107. Thus, the vehicle door cannot be unlocked and opened by breaking the window and unlocking the door using the inside sill button or the passenger compartment switch 107.

The electrically powered actuator 91 that extends and retracts the plunger 89 and the positive detent 105 that locks the plunger 89 in the extended lock position can take any suitable form. Examples of suitable devices can be found in U.S. Pat. No. 4,342,209 granted to Frank Kleefeldt Aug. 3, 1982; U.S. Pat. No. 4,364,249 granted to Frank Kleefeldt Dec. 21, 1982; U.S. Pat. No. 4,440,006 granted to Frank Kleefeldt Aug. 3, 1984; and U.S. Pat. No. 4,727,301 granted to Gary C. Fulks, David A. McKernon and Voja Savic Feb. 23, 1988.

The anti-theft feature is disengaged solely through the key lock cylinder 95 by inserting the key and turning it counterclockwise from the neutral position N to the unlock position UL. This disengages the detent 105 and retracts the plunger 89 so that the locking lever part 41 is rotated counterclockwise back to the unlocked position shown in FIG. 1 from the locked position as shown in FIG. 2. The locking lever part 40 is also rotated counterclockwise back to the unlocked position shown in FIG. 1, from the locked position shown in FIG. 2, due to the detent interlock between the two locking lever parts 40 and 41 provided by knob 97 and pocket 101.

Counterclockwise rotation of the locking lever part 40, rotates intermittent lever 34 clockwise back to the unlock position shown in FIG. 1. The door lock 10 can now be unlatched by operating either the inside operating lever 56 or the outside operating lever 50 to rotate the transfer lever 44 and pull the intermittent lever 34 and the detent lever 32 down so that the fork bolt 30 is free to rotate clockwise from the latched position shown in FIG. 1.

OVERRIDE FEATURE

In addition to the anti-theft feature, the vehicle door latch 10 also includes an override feature to unlock the door latch 10 mechanically in the event of power failure, that is, in the event that the anti-theft feature cannot be disengaged electrically by turning the key in the key lock cylinder to the unlock position UL.

This override feature comprises the mechanical linkage 93 that is operated by turning the key counterclockwise in the key lock cylinder 95 past the unlock position UL to the dead bolt unlock position DBU. This linkage operates on the outside locking lever 82 so that the outside locking lever 82 is rotated counterclockwise from the position shown in FIG. 2 to the position shown in FIG. 3. During this movement, an edge of the sector shaped slot 86 engages the projection 88 of the locking lever part 40 and rotates the locking lever part 40 counterclockwise relative to the locking lever part 41 from the locked position shown in FIG. 2 to the unlocked position shown in FIG. 3. The locking lever part 40, in turn, rotates the intermittent lever 34 clockwise to the unlocked position shown in FIG. 3, where the intermittent lever 34 can be pulled down to unlatch the detent lever 32 from the fork bolt 30 as described earlier.

As indicated above, when the mechanical override is actuated, the locking lever part 40 is rotated counterclockwise relative to the locking lever part 41 which, of course, is held in a fixed position by the engaged anti-theft feature that locks the plunger 89 in the extended position. This relative rotation or angular displacement is possible because of the releasable detent and lost motion connection between the two parts that have been described briefly above and will now be described in detail.

When the outside locking lever 82 is rotated counterclockwise from the position shown in FIG. 2 to the position shown in FIG. 3, it picks up the projection 88 and applies torque to the locking lever part 40. The applied torque eventually overcomes the spring force holding the knob 97 in the pocket 101 and cams the knob 97 out of the pocket 101 so that the locking lever part 40 rotates counterclockwise relative to the locking lever part 41 from the locked position shown in FIG. 2 to the unlocked position shown in FIG. 3. When the locking lever part 40 reaches the unlocked position, the projection 88 bottoms out in the sector shaped slot 83 ending the relative rotation in the counterclockwise direction. The knot 97 then also snaps into the second pocket 103 recoupling the locking lever parts 40 and 41 for return to their normal operating relationship.

Once power is restored, the door lock 10 can be unlocked electrically by turning the key in the key lock cylinder 95 to the unlock position UL shown in FIG. 1. This now disengages the detent 105, retracts the plunger 89 and rotates the locking lever part 41 counterclockwise from the locked position shown in FIG. 3 back to the unlocked position shown in FIG. 1. The locking lever part 41 is rotated counterclockwise relative to the locking lever part 40 which is already in the unlocked position and held there by the latching mechanism comprising the intermittent lever 34 and the detent lever 32. The counterclockwise torque applied to the locking lever 41 overcomes the spring force holding the knob 97 in the pocket 103 allowing the locking lever part 41 to rotate counterclockwise relative to the locking lever part 40 until the sector shaped slot 83 of the locking lever part 41 bottoms out on the protrusion 88 of the locking lever part 40. When this occurs, the knob 97 returns to pocket 101 and the locking lever parts 40 and 41 are positioned for normal operation as shown in FIG. 1.

The invention has been described in an illustrative manner, and it is to be understood that the terminology which has been used is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

The embodiments of the invention in which an exclusive property or privilege is claimed are defined as follows:

1. A vehicle door latch having an anti-theft feature that disables an inside lock operator and an override feature that unlocks the vehicle door latch when the anti-theft feature is engaged comprising;

a fork bolt that is moveable between a latched position and an unlatched position, the fork bolt having a latch shoulder that is engaged by a detent to hold it in the latched position, an intermittent member that is operatively connected to the detent for disengaging the detent from the latch shoulder of the fork bolt, a locking member that is moveable relative to the intermittent member and operatively connected to the intermittent member for moving the intermittent member between an unlocked position and a locked position, a first operating member connected to the locking member for moving the locking member so that it moves the intermittent member between an unlocked position and a locked position, a second operating member connected to the locking member for moving the locking member so that the locking member moves the intermittent member between an unlocked position and a locked position, and an anti-theft member that locks the locking member so that the intermittent member cannot be moved from a locked position to an unlocked position by the first operating member but can be moved from a locked position to an unlocked position by the second operating member the locking member has a first part and a second part that contacts and moves relative to the first part, and wherein the first operating member is connected to the first part of the locking member and the second operating member is connected to the second part of the locking member that moves relative to the first part.

2. The vehicle door latch as defined in claim 1, wherein the first part and second part of the locking member are coupled by a releasable detent.

3. The vehicle door latch as defined in claim 2, wherein the first part and second part of the locking member are coupled by a lost motion connection that limits the relative angular displacement of the parts with respect to each other.

4. A vehicle door latch having an anti-theft feature that disables an inside lock operator and an override feature that unlocks the vehicle door latch when the anti-theft feature is engaged comprising;

a fork bolt that is moveable between a latched position and an unlatched position, a detent that is moveable between a detent position holding the fork bolt in the latched position and a release position disengaged from the fork bolt, a latch mechanism operatively connected to the detent for moving it from the detent position to the release position, a multi-part locking member having a first locking part that is movable between an unlock position enabling the latch mechanism to move the detent from the detent position to the release position and a lock position disabling the latch mechanism so that it cannot move the detent from the detent position to the release position, the multi-part locking member having a second locking part that contacts and is releasably coupled to the first locking part, a first operating member connected to the second part of the locking member for moving the first locking part between the unlock position and the lock position, a second operating member connected to the first locking part for moving the first locking part between the lock position and the unlock position, and an anti-theft member that locks the second locking part so that the first locking part cannot be moved from a locked position to an unlocked position by the first operating member but can be moved from a locked position to an unlocked position by the second operating member.

5. The vehicle door latch as defined in claim 4, wherein the second locking part is releasably coupled to the first locking part by a spring biased detent comprising a knob on an integral leaf spring of one of the first locking part and the second locking part and pockets for receiving the knob in another of the first locking part and the second locking part.

6. The vehicle door latch as defined in claim 4, wherein the first and second parts are coupled by a lost motion connection that limits the relative angular displacement of the parts with respect to each other.

7. The vehicle door latch as defined in claim 6, wherein the lost motion connection comprises a projection in one part that is disposed in a slot of the other part.

8. The vehicle door latch as defined in claim 7, wherein the projection is on the first locking part and the projection is engaged by the second operating member for moving the first part between the lock position and the unlock position.

9. The vehicle door latch as defined in claim 4, wherein the first operating member is a mechanical lever.

10. The vehicle door latch as defined in claim 4, wherein the first operating member is a plunger of an electrically powered actuator.

11. The vehicle door latch as defined in claim 9, further including an electrically powered actuator having a plunger that is connected to the second locking part of the locking member for moving the second locking part between the unlock position and the lock position.

12. The vehicle door latch as defined in claim 11, wherein the anti-theft member is an electrically powered detent that operates on the plunger.

13. A vehicle door latch having an anti-theft feature that disables an inside lock operator and an override feature that unlocks the vehicle door latch when the anti-theft feature is engaged comprising;

a fork bolt that is moveable between a latched position and an unlatched position, the fork bolt having a latch shoulder that is engaged by a detent to hold it in the latched position, an intermittent member that is operatively connected to the detent for disengaging the detent from the latch shoulder of the fork bolt, a first locking member that is moveable relative to the intermittent member between an unlocked position and a locked position and operatively connected to the intermittent lever for moving the intermittent member between an unlocked position and a locked position, a second locking member that contacts and is releasably coupled to the first locking member for moving the first locking member between the unlocked position and the locked position of the first locking member, a first operating member connected to the first locking member for moving the first locking member between an unlocked position and a locked position, a second operating member connected to the second locking member for moving the second locking member between the unlocked position and the locked position of the second locking member, an anti-theft member that locks the second locking member so that the first locking member cannot be moved by the second locking member, and a third operating member connected to the first locking member for releasing the first locking member from the second locking member when the second locking member is locked and moving the first locking member from the locked position to the unlocked position of the first locking member.

14. The vehicle door latch as defined in claim 13, wherein the first locking member and the second locking member are rotatable about a common axis.

15. The vehicle door latch as defined in claim 14, wherein the first locking member and the second locking member are releasably coupled by a spring biased detent in first and second relative angular positions.

16. The vehicle door latch as defined in claim 14, wherein the first locking member and the second locking member are coupled by a lost motion connection that limits the relative angular displacement of the locking members with respect to each other.

17. The vehicle door latch as defined in claim 15, wherein the first locking member and the second locking member are coupled by a lost motion connection that limits the relative angular displacement of the locking members with respect to each other.

18. The vehicle door latch as defined in claim 13 wherein the first operating member is an inside operating member and the second and third operating members are outside operating members.

19. The vehicle door latch as defined in claim 17 wherein the first operating member is an inside operating member and the second and third operating members are outside operating members.

* * * * *